US005172082A

United States Patent [19]

Livingston et al.

[11] Patent Number: 5,172,082

[45] Date of Patent: Dec. 15, 1992

[54] MULTI-OCTAVE BANDWIDTH BALUN

[75] Inventors: Stan W. Livingston, Fullerton; Jar J. Lee, Irvine; Nam S. Wong, Fullerton, all of Calif.

[73] Assignee: Hughes Aircraft Company, Los Angeles, Calif.

[21] Appl. No.: 687,809

[22] Filed: Apr. 19, 1991

[51] Int. Cl.[5] ..... H01P 5/10

[52] U.S. Cl. ..... 333/26; 333/161

[58] Field of Search ..... 333/26, 161; 455/327

[56] References Cited

U.S. PATENT DOCUMENTS

| | | | |
|---|---|---|---|
| 3,523,260 | 8/1970 | Gunshinen et al. | 333/26 |
| 3,678,418 | 7/1972 | Woodward | 333/26 |
| 4,460,877 | 7/1984 | Sterns | 333/26 |
| 4,725,792 | 2/1988 | Lampe, Jr. | 333/26 |

FOREIGN PATENT DOCUMENTS

| | | | |
|---|---|---|---|
| 148405 | 8/1984 | Japan | 333/26 |

OTHER PUBLICATIONS

*The Balun Family*, H. Shuhao, Microwave Journal, Sep. 1987, pp. 227–229.

"Broadband Stipline Balun Using Quadrature Couplers," S. Walker, IEEE Transactions on Microwave Theory and Techniques, Feb. 1968, pp. 132–133.

*Primary Examiner*—Paul Gensler

*Attorney, Agent, or Firm*—Wanda K. Denson-Low

[57] ABSTRACT

A balun structure including a dielectric substrate having top and bottom surfaces on which are formed a splitter/combiner, a reference transmission line of length A and substantially constant characteristic impedance, and an inverting transmission line of length A and substantially constant characteristic impedance. The inverting transmission line in particular includes a first tapered planar section disposed on the top surface of the substrate and transitioning along its length from a narrow width to a wide width, and a second tapered planar section disposed on the bottom surface of the substrate and transitioning along its length from a wide width to a narrow width, such that the first and second tapered planar sections are rotated mirror images of each other.

6 Claims, 4 Drawing Sheets

MULTI-OCTAVE BANDWIDTH BALUN

BACKGROUND OF THE INVENTION

The subject invention is generally directed to phase inverting baluns, and is directed more particularly to a phase inverting balun structure that operates over a multi-octave bandwidth.

Phase inverting baluns are two-way power dividers with anti-phase outputs that are commonly utilized in a variety of feed networks ranging from cable TV applications to radar and array antenna applications. A known phase inverting balun for radar applications comprises a Magic Tee, or a stripline version of the waveguide device (a 180 degree hybrid coupler). The two ports provide two anti-phase signals. Conventionally, the 180 degree output is achieved by using a 90 degree quadrature hybrid plus a 90 degree phase shifter, or by inserting a delay line in one of the two arms with respect to the other. Either way, it is difficult to achieve the phase inversion over a multi-octave bandwidth. Other designs also provide band limited performance.

"Broadband Stripline Balun Using Quadrature Couplers," IEEE TRANSACTIONS ON MICROWAVE THEORY AND TECHNIQUES, February 1968, pages 132–133 and "The Balun Family," Shuhao, MICROWAVE JOURNAL, September 1987, pages 227–229, include examples of known phase inverting balun designs.

In addition to band limited performance considerations, known baluns structures that presently have the widest bandwidths are complex and expensive.

SUMMARY OF THE INVENTION

It would therefore be an advantage to provide a balun structure having a wide bandwidth.

Another advantage would be to provide a wide bandwidth balun structure that is capable of being manufactured at relatively low cost.

The foregoing and other advantages are provided by the invention in a balun structure that includes a dielectric substrate having top and bottom surfaces on which are formed a splitter/combiner, a reference transmission line of length A and substantially constant characteristic impedance, and an inverting transmission line of length A and substantially constant characteristic impedance. The inverting transmission line in particular includes a first tapered planar section disposed on the top surface of the substrate and transitioning along its length from a narrow width to a wide width, and a second tapered planar section disposed on the bottom surface of the substrate and transitioning along its length from a wide width to a narrow width, such that the first and second tapered planar sections are rotated mirror images of each other.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figures 1, 2:
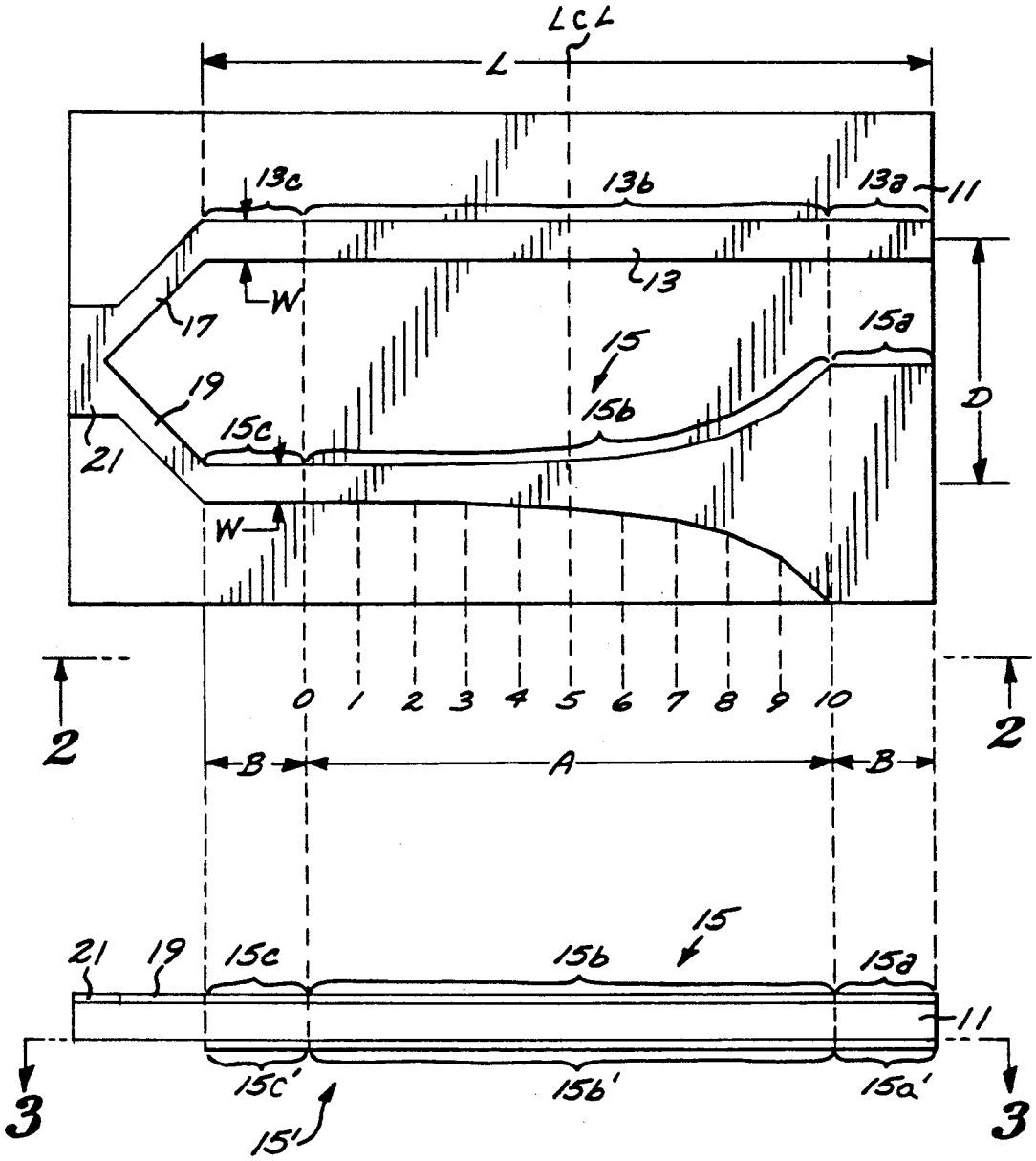
FIG. 1 is a top plan view of a balun structure in accordance with the invention.
FIG. 2 is an elevational sectional view of the balun structure of FIG. 1.

In the following detailed description and in the several figures of the drawing, like elements are identified with like reference numerals.

Referring now to FIGS. 1–4, schematically depicted therein by way of an illustrative example of the invention is a balun structure that includes a dielectric substrate 11 having planar parallel top and bottom surfaces for supporting metallization traces that form the transmission lines of the balun. The top surface supports a constant width top conductive strip section 13 and a tapered top conductive section 15 which have parallel longitudinal centerlines. The top conductive strip section 13 and the top tapered section 15 extend inwardly from a first edge of the substrate and have a length L.

The tapered conductive section 15 includes constant width wide subsection **15*a* adjacent the first substrate edge, a tapered subsection 15*b* which becomes narrower with distance from the wide section, and a constant width strip subsection 15*c* at the narrow end of the tapered section 15*b*. The tapered subsection 15*b* has a length A that is greater than or equal to one-fourth the longest effective transmission line wavelength of interest (i.e., for the lowest frequency of interest). The wide subsection 15*a* and the strip subsection 15*c* are of substantially identical length, and tapered subsection 15*b* transitions along its length from the wide subsection 15*a* to the strip subsection 15*b***.

For reference purposes, the constant width top conductive strip 13 includes subsections **13*a*, 13*b*, 13*c* which correspond in length to the subsections 15*a*, 15*b*, 15*c* of the top tapered conductive strip 15**.

For further reference purposes, a lateral centerline LCL is defined as being perpendicular to the longitudinal centerline of the top tapered conductive section 15, coplanar with such top tapered conductive section, and passing through the longitudinal center of the tapered subsection **15*b* which is coincident with the longitudinal center of the tapered conductive section 15**.

The inner ends of the constant width conductive strip section 13 and the tapered conductive section 15 are connected to first ends of angled conductive microstrip sections 17, 19 which are angled toward each other. The second ends of the angled sections 17, 19 converge to join at the inside end of a constant width strip section 21 which extends inwardly from a second edge of the substrate that is opposite the first edge.

Figure 3:
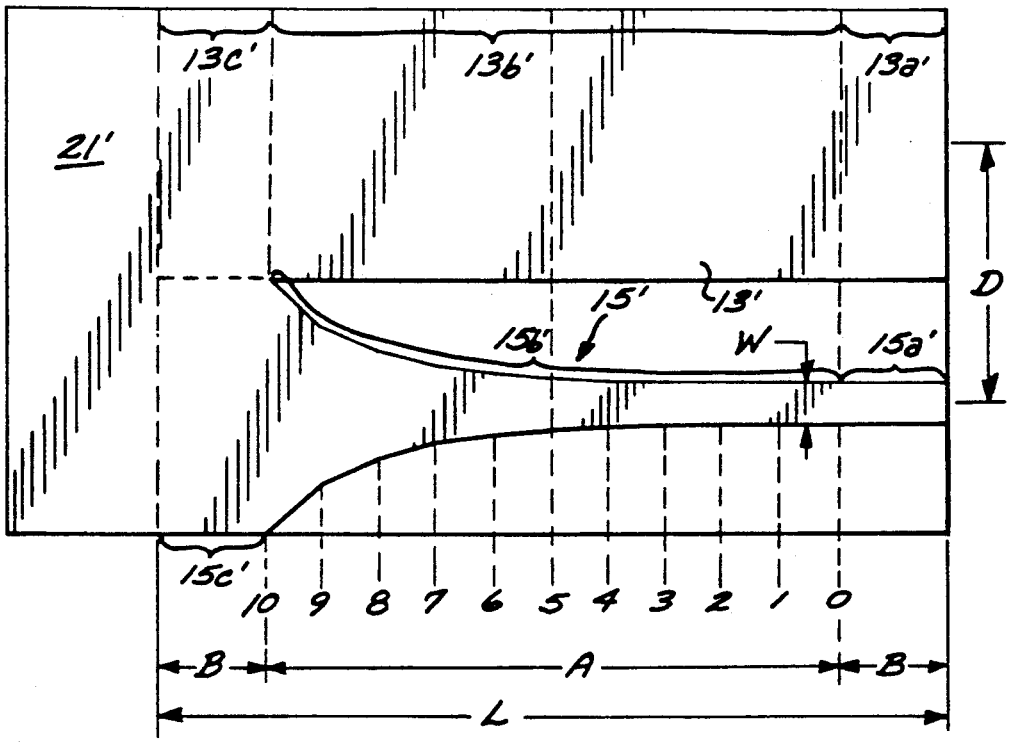
FIG. 3 is a sectional view of the bottom metallization of the balun structure of FIG. 1.
Figure 4:
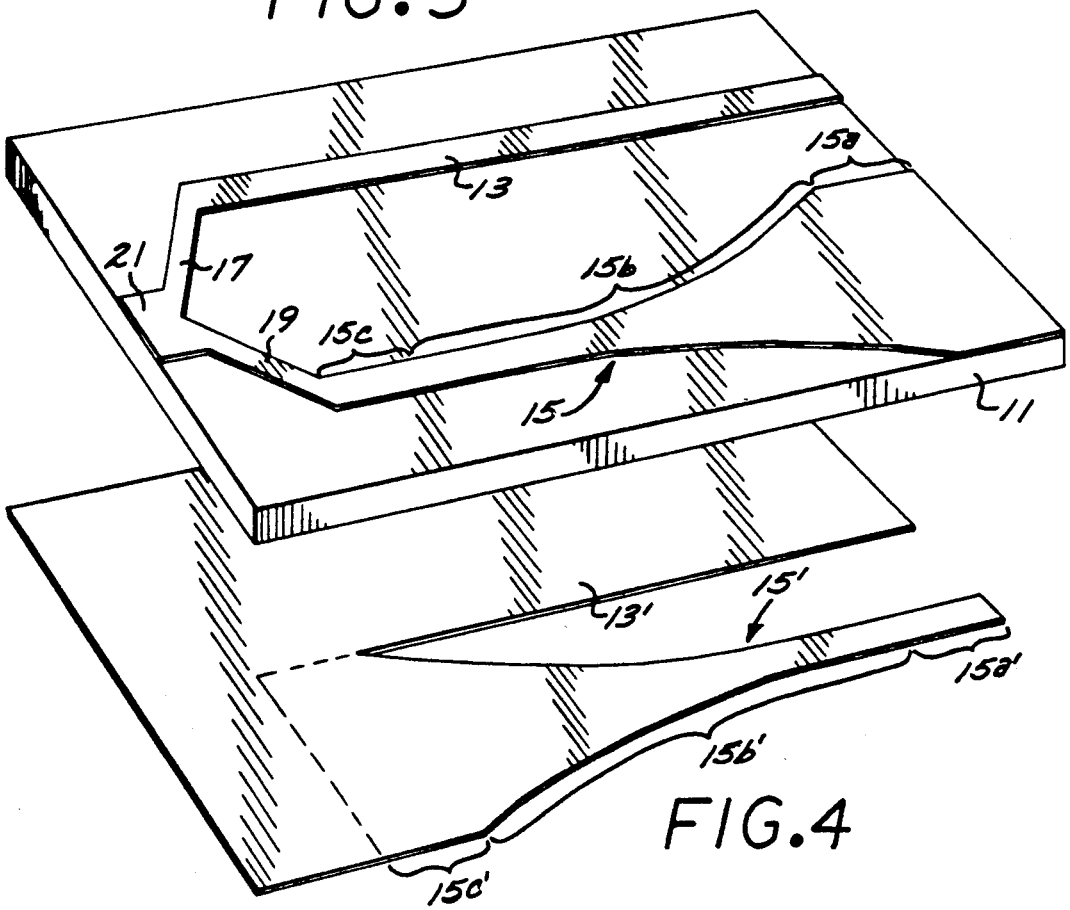
FIG. 4 is partially exploded isometric view of the balun structure of FIG. 1.

As shown in FIGS. 3 and 4, the bottom surface of the substrate supports a bottom conductive area that includes a tapered bottom section 15' that comprises a projection of the rotated mirror image of the upper tapered microstrip section 15 as rotated about the lateral centerline axis LCL. In particular, the bottom section 15' is defined by rotating the image of the top conductive tapered section 15 180 degrees about the lateral centerline LCL and projecting the rotated image onto the bottom planar surface of the substrate 11.

The bottom conductive tapered section 15' in particular includes a strip subsection 15a' that extends inwardly from the first substrate edge, and is beneath and of the same length as the wide subsection 15a of the top tapered section 15. A tapered subsection 15b' is beneath and of the same length A as the tapered subsection 15b of the top o tapered section 15. A wide subsection 15c' is beneath and of the same length as the strip subsection 15c of the top conductive tapered section 15. The metallization on the bottom substrate surface is configured such that metallization that extends laterally from beneath the strip section 13 extends only to the line defined by the inside edge of the wide subsection 15c'. In this manner, the metallization extends to such inside edge of the wide subsection 15c' and to beneath the inside edge of the wide subsection 15a of the top conductive tapered section 15.

The bottom metallization 13' that is beneath the constant width top conductive strip section 13 includes subsections 13a', 13b', 13c' which are of the same lengths as the overlying subsections 13a, 13b, 13c. The remaining portion of the bottom metallization that is beneath the top conductive strips 17, 19, 21 has the reference numeral 21'.

The respective upper strip sections together with the underlying metallization effectively form respective 2-conductor transmission lines. The transmission lines that include the top conductive strips 17, 19, 21 and the bottom metallization portion 21' form a power divider/-combiner; the transmission line that includes the constant width strip subsection 13b and the bottom metallization region 13b' forms a reference line; the transmission line that includes the upper tapered subsection 15b and the lower tapered subsection 15b' forms an inversion line; and the lines that include the subsections 13a, 13c, 15a, and 15c form transitions, for example for connection to other lines.

The width and dimensions of the transmission lines comprising the balun are selected to provide substantially constant impedances along the lengths of the transmission lines, for example pursuant to known numerical analytical techniques. For matching, the characteristic impedance of the transmission line that includes the upper conductive strip 21 is one-half the characteristic impedance that is the same for the remaining transmission lines.

Figure 5:
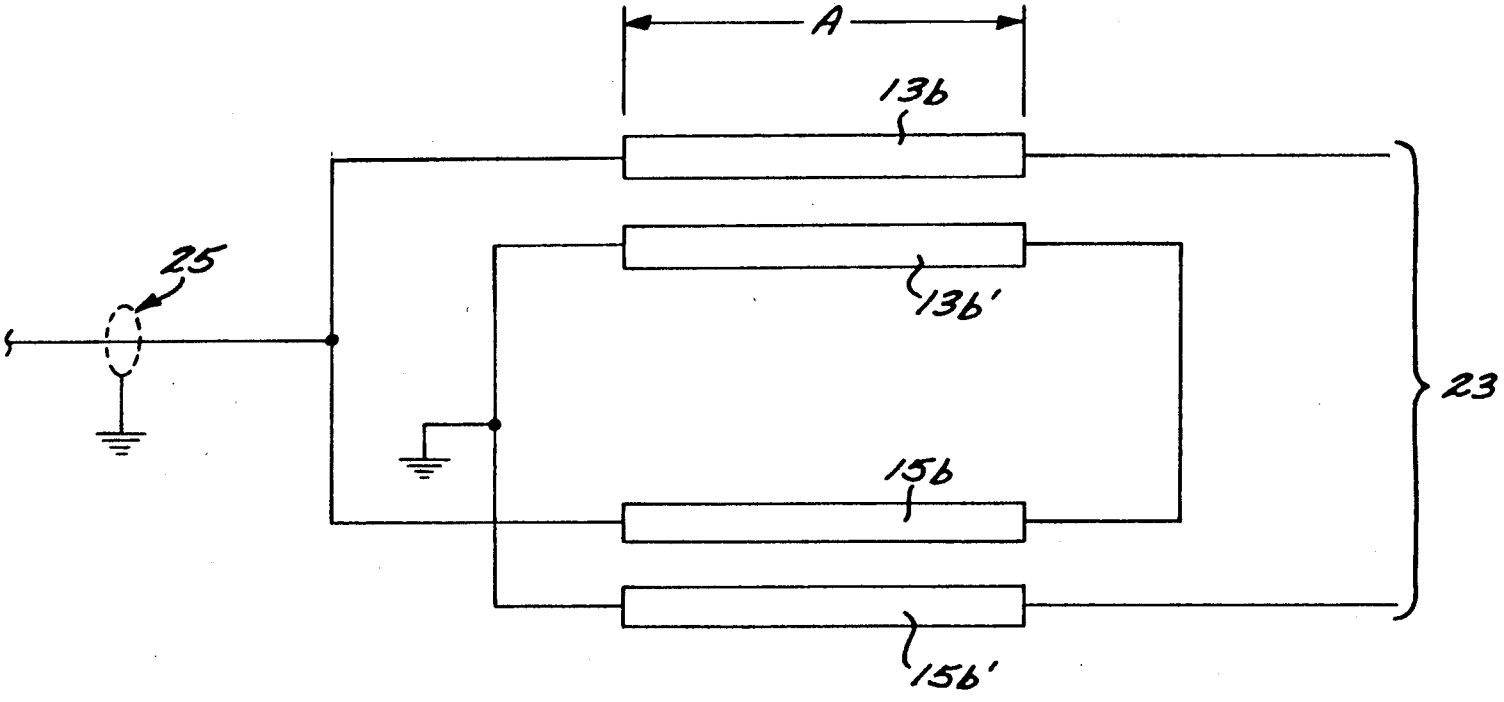
FIG. 5 is a schematic diagram illustrating the connections of a differential line and a non-differential line to the balun structure of FIG. 1

Referring now to FIG. 5, schematically illustrated therein are the connections made to the balun structure of FIGS. 1–4 for use thereof. Corresponding first ends of the top subsection 13b of length A and the bottom subsection 15b' of length A are respectively electrically connected to the leads of a differential line 23 such as twin lead via the top subsection 13a and the bottom subsection 15a. Corresponding first ends of the lower subsection 13b' and the top subsection 15b (i.e., the wide end of 15b) are electrically shorted together via subsections 13a' and 15a, for example by connection to a chassis in which the balun is housed. Corresponding second ends of the top subsection 13b and the top subsection 15b (i.e., the narrow end of 15b) are connected via the top conductive strips 17, 19, 21 to the non-grounded conductor of a non-differential line 25 such as the center conductor of a coaxial cable. The corresponding second ends of the bottom subsection 13b' and the bottom subsection 15b' (i.e., the wide end of 15b') are electrically shorted together with the bottom metallization region 21' which in turn is connected to the ground plane for the non-differential line, such as the shielding of a coaxial cable, for example via the chassis in which the balun is housed. Briefly stated, the wide end of the top tapered subsection 15b is shorted with the corresponding end of the wide bottom subsection 13b'; and the wide end of the lower tapered subsection 15b' is shorted with the corresponding end of the wide bottom subsection 13b'.

In operation, the inversion line (15b, 15b') provides for phase inversion relative to the reference line (13b, 13b') as a result of exchanging the roles of the top and bottom tapered subsections 15b, 15b'. In particular, the top tapered subsection 15b changes from a ground plane at the right end to a microstrip at the left end. Conversely, the lower tapered subsection 15b' changes from a ground plane at the left end and changes to a microstrip at the right end.

While the balun structure of FIGS. 1 and 2 is implemented in a unitized manner on a single substrate 11, it should be appreciated that it can be implemented with only the reference line (13b, 13b'), the inversion line (15b, 15b'), and the transitions (13a, 13a' 13c, 13c' 15a, 15a' 15c, 15c') being formed on the substrate, in which case the splitter/ combiner is a separate unit. The transitions would be utilized for connections to the splitter combiner and the differential line.

Referring now to the indications of dimensions in FIGS. 1 and 2, the reference transmission line and the inversion transmission line, which together form an inverted line, can be implemented with the following dimensions.

| | |
|---|---|
| Substrate thickness T: | 0.032 inches |
| Substrate dielectric constant: | 2.55 |
| Metallization thickness: | 0.001 inches |
| Distance D between upper conductor centerlines: | 0.600 inches |
| Width WA of constant width upper strip 13: | 0.088 inches |
| Width WB of narrow end of upper strip 15: | 0.088 inches |
| Width WB' of narrow end of lower strip 15': | 0.088 inches |
| Specific values for length A measured | 1.327 inches |
| between Line Positions L0 and L1: | 1.989 inches |
| | 2.653 inches |
| Length L of conductive strips 13, 15, 15': | A + 0.500 inches |
| Distance B from substrate edge to Line Position L0: | 0.250 inches |
| Distance B from substrate edge of Line Position L10: | 0.250 inches |
| Width of upper strip 15 at Line Positions L0 through L10 which are separated by A/10: | |
| Line Position L0: | 0.088 inches |
| Line Position L1: | 0.091 inches |
| Line Position L2: | 0.092 inches |
| Line Position L3: | 0.096 inches |
| Line Position L4: | 0.102 inches |
| Line Position L5: | 0.114 inches |
| Line Position L6: | 0.135 inches |
| Line Position L7: | 0.174 inches |
| Line Position L8: | 0.244 inches |
| Line Position L9: | 0.371 inches |
| Line Position L10: | 0.600 inches |
| Width of lower conductive strip 15 at Line Positions L0 through L10: | |
| Line Position L0: | 0.600 inches |
| Line Position L1: | 0.371 inches |
| Line Position L2: | 0.244 inches |
| Line Position L3: | 0.174 inches |
| Line Position L4: | 0.135 inches |
| Line Position L5: | 0.114 inches |
| Line Position L6: | 0.102 inches |
| Line position L7: | 0.096 inches |
| Line Position L8: | 0.092 inches |
| Line Position L9: | 0.091 inches |
| Line Position L10: | 0.088 inches |

As specified earlier, the lower conductive strip 15' is the rotated mirror image of the upper conductive strip 15, with the rotation being about the axis that passes through the axis that pass through the midpoint of the lower conductive strip 15'. In the illustration of FIG. 1, that axis of rotation passes through Line Position 5.

Figure 6A:
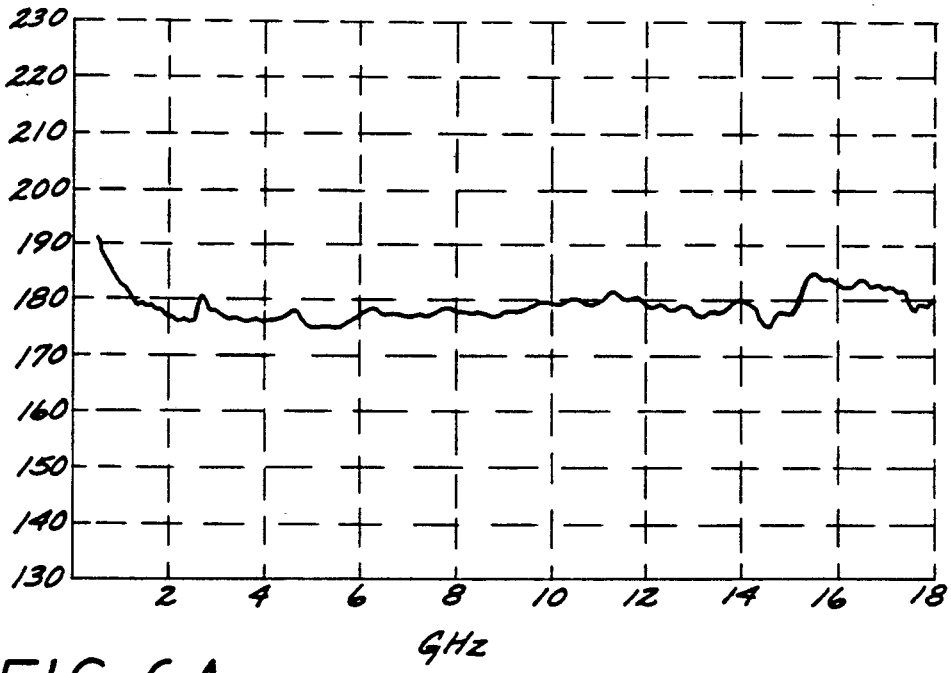
FIGS. 6A and 6B are graphs illustrating the phase and amplitude of the output of the inversion line of the balun structure of FIG. 1.
Figure 6B:
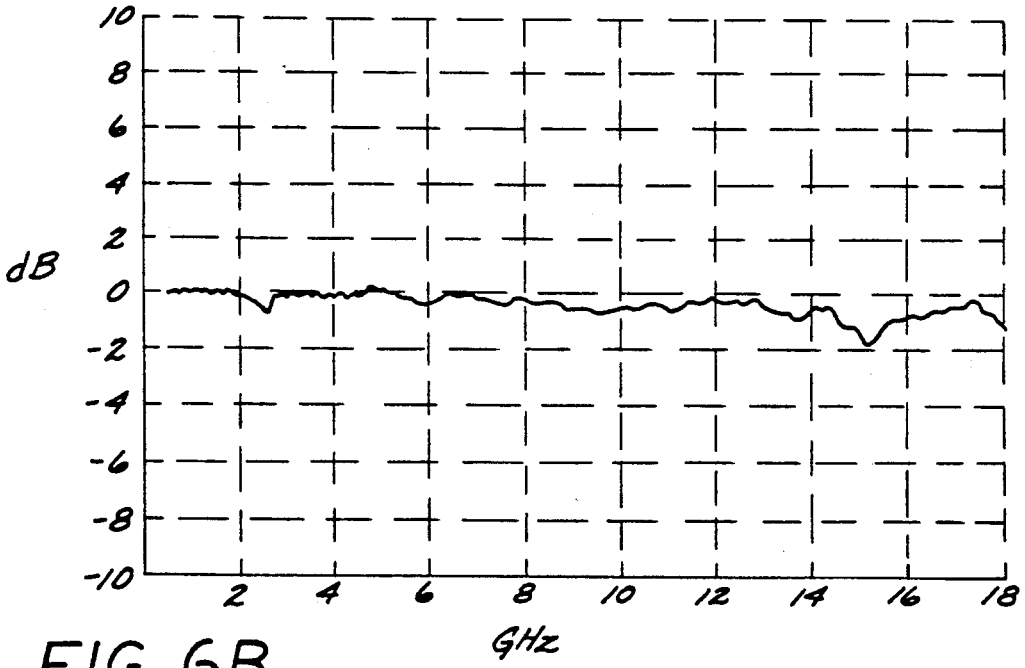

Referring now to FIGS. 6A and 6B, set forth therein are graphs illustrating the phase and amplitude of the anti-phase output relative to the in-phase output of a balun having a reference line and an inverting line in accordance with the foregoing dimensions for a length A of 1.989 inches.

Although the foregoing has been a description and illustration of specific embodiments of the invention, various modifications and changes thereto can be made by persons skilled in the art without departing from the scope and spirit of the invention as defined by the following claims.

What is claimed is:

1. A wide bandwidth phase inverting balun structure comprising:

a splitter/combiner having a first port for connection to a non-differential line and further having second and third ports for providing split outputs or for receiving inputs to be combined;

a reference transmission line of length A and substantially constant characteristic impedance, said reference transmission line having a narrow strip section and an associated wide conductive strip section dielectrically separated from said narrow strip section. The first end of said narrow strip section for connection to one lead of a differential line, the second end of said narrow strip section being connected to said second splitter/combiner port; and a phase inverting transmission line of length A and substantially constant characteristic impedance along its length, said phase inverting transmission line having a first tapered planar section that transitions along its length from a narrow width end at the second end of the phase inverting transmission line to a wide width at the first end of the inverting transmissinline, said wide width end for electrical connection to the end of said wide conductive strip section at the first end of the reference transmission line; and a second tapered planar section dielectrically spaced from and parallel to said first tapered planar section, said second tapered planar section transitioning along its length from a wide width end at the second end of the inverting transmission line to a narrow width end at the first end of the inverting transmission line, said wide width end for electrical connection to the end of said wide conductive strip section at the second end of the reference transmission line;

said first and second tapered planar sections being rotated mirror images of each other, with the rotation being about an axis that is perpendicular to the longitudinal axes of said first and second tapered planar sections and in the plane of the planar section being rotated, the first end of said inverting transmission line for connection to the other lead of the differential line, the second end of said inverting transmission line being connected to said third combiner/splitter part.

2. A balun structure comprising:

a dielectric substrate having top and bottom surfaces;

a splitter/combiner formed on the top and bottom surfaces of said dielectric substrate, said splitter/combiner having a first port for connection to a non-differential line and further having second and third ports for providing split outputs or for receiving inputs to be combined;

a reference transmission line of length A and substantially constant characteristic impedance formed on the top and bottom surfaces of said dielectric substrate, said reference transmission line having a narrow strip section formed on the top of said dielectric substrate and a wide strip section formed on the bottom of said dielectric substrate beneath said narrow strip section, the first end of said narrow strip section for connection to one lead of a differential line, the second end of said narrow strip section being connected to said second splitter/combiner port; and a phase inverting transmission line of length A and substantially constant characteristic impedance formed on the top and bottom surfaces of said dielectric substrate, said phase inverting transmission line having a first tapered planar section formed on the top surface of said dielectric substrate and transitioning along its length from a narrow width end at the second end of the phase inverting transmission line to a wide width end at the first end of the inverting transmission line, said wide width end for electrical connection to the end of said wide conductive strip section at the first end of the reference transmission line; and a second tapered planar section on the bottom of said dielectric substrate beneath said first tapered planar section, said second tapered planar section transitioning along its length from a wide width end at the second end of the inverting transmission line to a narrow width end at the first end of the inverting transmission line, said wide width end for electrical connection to the end of said wide conductive strip section at the second end of the reference transmission line;

said first and second tapered planar section being rotated mirror images of each other, with the rotation being about an axis that is perpendicular to the longitudinal axes of said first and second tapered planar sections and in the plane of the planar section being rotated, the first end of said inverting transmission line for connection to the other lead of the differential line, the second end of said inverting transmission line being connected to said third combiner/splitter part.

3. A phase inverting structure comprising:

a dielectric substrate having top and bottom surfaces;

a reference transmission line of length A and substantially constant characteristic impedance along its length formed on the top and bottom surfaces, said transmission line including a narrow strip section disposed on the top surface of said substrate and a wide strip section disposed on the bottom surface of said substrate beneath said narrow strip section;

an phase inverting transmission line of length A and substantially constant characteristic impedance along its length formed on the top and bottom surfaces of said dielectric substrate, said inverting transmission line including:

a first tapered planar section disposed on the top surface of the substrate and transitioning along its length in a reference direction from a narrow width end to a wide width end, said wide width end for electrical connection to the first end of said wide strip section; and a second tapered planar section disposed on the bottom surface of the substrate and transitioning in said reference direction from a wide width end to a narrow width end, said wide width end for electrical connection to the second end of said wide strip section;

said first and second tapered planar sections being rotated mirror images of each other, with the rotation being about an axis that is perpendicular to the longitudinal axes of said first and second tapered planar sections and in the plane of the planar section being rotated.

4. A wide bandwidth phase inverting balun for high frequency signals comprising:

a flat dielectric substrate having a first surface and a second surface and a first end and a second end;

a first strip conductor disposed on the first surface of said dielectric and having a length greater than or equal to one quarter of the wavelength of the lowest frequency signal to be applied to said balun;

a second strip conductor disposed on the said first surface, said second strip conductor being parallel to said first strip conductor and of substantially the same length as said first strip conductor, said second strip conductor being tapered from a wide width at the first end to a narrow width at the second end;

a third strip conductor disposed on the second surface and being of substantially the same length as said first strip conductor, said third strip conductor including a first section disposed opposite said second strip conductor and being tapered from a narrow width at the first end to a wide width at the second end, and a second section disposed opposite said first strip conductor.

5. A wide bandwidth phase inverting balun as recited in claim 9 wherein said dielectric substrate extends beyond the narrow width end of said second strip conductor and the corresponding end of the first strip conductor and further comprising a strip conductor combiner/splitter disposed on the first surface of the dielectric substrate, said combiner/splitter having a first port at the second end of the dielectric substrate coupled to second and third ports, said second and third ports coupled to said the narrow width end of said second strip conductor and the corresponding end of the first strip conductor, respectively.

6. A wide bandwidth phase inverting balun for high frequency signals comprising:

a flat dielectric substrate having a first surface and a second surface and a first end and a second end;

a strip conductor combiner/splitter disposed on the first surface of the dielectric substrate, said combiner/splitter having a first port at the second end of the dielectric substrate and second and third ports coupled to said first port;

a first strip conductor disposed on the first surface of said dielectric and having a length greater than or equal to one quarter of the wavelength of the lowest frequency signal to be applied to said balun;

a second strip conductor disposed on the said first surface, said second strip conductor being parallel to said first strip conductor and of substantially the same length as said first strip conductor, said second strip conductor being tapered from a wide width at the first end to a narrow width;

a third strip conductor disposed on the second surface and being of substantially the same length as said first strip conductor, said third strip conductor including a first section disposed opposite said second strip conductor and being tapered from a narrow width at the first end to a wide width at the second end, and a second section disposed opposite said first strip conductor; and said second port of the combiner/splitter being coupled to the second strip conductor at the narrow width end and said third port being coupled to the first strip conductor at the corresponding end of the first strip conductor.

* * * * *